US008042755B2

(12) United States Patent
Gingras

(10) Patent No.: US 8,042,755 B2
(45) Date of Patent: Oct. 25, 2011

(54) BAR AND GROOVE PATTERN FOR A REFINER PLATE AND METHOD FOR COMPRESSION REFINING

(75) Inventor: Luc Gingras, Harrogate (GB)

(73) Assignee: Andritz Inc., Glens Falls, NY (US)

( * ) Notice: Subject to any disclaimer, the term of this patent is extended or adjusted under 35 U.S.C. 154(b) by 83 days.

(21) Appl. No.: 12/329,245

(22) Filed: Dec. 5, 2008

(65) Prior Publication Data

US 2009/0173812 A1 Jul. 9, 2009

Related U.S. Application Data

(60) Provisional application No. 61/019,354, filed on Jan. 7, 2008.

(51) Int. Cl.
*B02C 7/04* (2006.01)

(52) U.S. Cl. ..... 241/261.3; 241/297

(58) Field of Classification Search ..... 241/261.3, 241/261.2, 298, 297, 296
See application file for complete search history.

(56) References Cited

U.S. PATENT DOCUMENTS

| | | | | |
|---|---|---|---|---|
| 291,010 | A * | 12/1883 | Woolever | 241/296 |
| 992,000 | A * | 5/1911 | Kihlgren | 241/261.2 |
| 1,725,155 | A * | 8/1929 | McAllister | 241/163 |
| 3,506,202 | A | 4/1970 | Cumpston, Jr. | |
| 4,678,127 | A | 7/1987 | Cumpston | |
| 4,712,745 | A | 12/1987 | Leith | |
| 5,467,931 | A * | 11/1995 | Dodd | 241/261.2 |
| 6,616,078 | B1 | 9/2003 | Gingras | |
| 2005/0247808 | A1 * | 11/2005 | Huhtanen et al. | 241/261.1 |

FOREIGN PATENT DOCUMENTS

| | | | |
|---|---|---|---|
| EP | 0 412 833 | A2 | 2/1991 |
| WO | 00/56459 | A1 | 9/2000 |
| WO | 2004/004909 | A1 | 1/2004 |
| WO | 2007/106294 | A1 | 9/2007 |

OTHER PUBLICATIONS

International Search Report for EP Application No. 08 173082 (Mar. 24, 2009).

* cited by examiner

*Primary Examiner* — Faye Francis
(74) *Attorney, Agent, or Firm* — Nixon & Vanderhye P.C.

(57) ABSTRACT

A refiner plate for a mechanical refining system, the plate including: a refining surface including bars and grooves, wherein the bars have a leading edge defined by an interior angle of between 150 degrees to 175 degrees.

19 Claims, 5 Drawing Sheets

BAR AND GROOVE PATTERN FOR A REFINER PLATE AND METHOD FOR COMPRESSION REFINING

This application claims the benefit of U.S. Provisional Patent Application 61/019,354, filed Jan. 7, 2008, the entirety of which is incorporated by reference

BACKGROUND OF THE INVENTION

This invention relates to the comminution of lignocellulosic materials (referred to herein as "fibrous material" or "wood fibrous material") and, particularly, to comminution using refiner plates having bars and grooves to separate fibers from lignocellulosic materials.

The invention is applicable to bar and groove designs for various types of refiner plates, including but not limited to disk refiners, counter-rotating disk refiners, twin and twin-flow refiners, cylindrical refiners, conical refiners and conical-disk refiners.

Refiner plates typically are arranged in a refiner to have facing surface separated by a gap. The plates rotate relative to each other. The fibrous material is introduced into the gap between the plates, typically, by flowing through a center inlet in one of the plates. The fibrous material flows in the gap between the plates and, in doing so, moves across the bars on the facing surfaces of the plates. As the fibrous material moves over the bars, the bars apply forces, such as compression pulses and impact forces, to the material. These forces tend to be greatest when the bars on the opposite plates cross over each other. The forces applied to the fibrous material act on the network of fibers in the material to separate individual fibers from the network and further develop these fibers. The separation of individual fibers and repeated compression of the fibrous mass results in the refining of the fibrous material.

Conventional refiner plates have refining bars separated by grooves arranged on a surface of the plate. The fibrous material, steam, water and other material flow through the grooves and over the bars as the material moves radially outward between the plates. Refining of the fibrous material tends not to occur in the groves. Refining occurs primarily as the fibrous material moves over the top ridges of the bars. The groves may include dams or other obstructions to prevent or restrict the flow of fibers and fluid through the grooves.

The bars typically include a sharp leading edge along a forward facing top edge of the bar. The conventional sharp leading edge angles of the bars are believed to promote shearing of the fibrous material passing over the bars. As bars on opposing plates pass each other, they impact and shear the fibrous material caught between the bars. The shear impacts of the fibrous material against the bar are a biproduct of the crossing of the bars. The shearing of fibrous material is undesirable.

Conventional wisdom views sharp leading edge angles as desirable to provide grooves with steep slopes such that the cross-sectional volume of the grooves provides sufficient flow capacity to move the fibrous material between the plates. A dull leading edge and its corresponding sloped leading face, i.e., leading sidewall, would result in conventional grooves having relatively narrow cross-sectional areas that may be insufficient to accommodate the flow of fibrous materials and the accompanying steam and water that should pass through the grooves. Examples of refiner plates with various types of leading edges on bars are shown in U.S. Pat. No. 5,039,022 entitled "Refiner Element Pattern Achieving Successive Compression Before Implact" and U.S. Pat. No. 4,678,127 entitled "Pumped Flow Attrition Disk Zone."

The crossing of opposite bars creates compressive pressure pulses that impact the fibrous material between the bars. The compression pulses apply mechanical force to the fibrous material that promote the refining of the fibrous material. The compression pulses are believed to provide desirable refining action by producing high strength fibrous material.

There is a long felt need for refiner plates that minimize the impact forces and resulting shearing of fibrous material and maximize compression pulses to refine the material.

BRIEF DESCRIPTION OF THE INVENTION

To reduce the shear impacts of energy transfer into the fibrous material, at least one of a pair of opposite refining elements includes bars having a dull bar edge. To reduce the tendency of sharp edges on the leading edge of bars to shear fibrous material, the leading edge angle of a bar should preferably be dull, e.g., between 150 degrees and 175 degrees. A dull leading edge on a bar should reduce the impacts between the bars and fibrous material that are caused by the sharp leading bar edges of conventional refiner plates. Minimizing the impacts should reduce shearing of fibrous materials and thereby maximize the strength of the fibers separated through repeated compression refining.

One embodiment of the invention is a refiner plate, such as a stator plate or a rotor plate, for a mechanical refining system, the plate comprising: a refining surface including bars and grooves, wherein the bars have a leading edge defined by an interior angle of between 150 degrees to 175 degrees. The bars may each include a leading face extending from the leading edge to a trailing face of an adjacent bar. The may include leading face having an upper sidewall section forming an angle of between 150 degrees to 175 degrees with respect to an upper ridge of the bar and a lower sidewall section substantially perpendicular to a substrate of the bar. Further, the leading face of the bars may be concave or convex. In addition, the trailing edge of the bars may have an interior angle of between 80 degrees to 140 degrees. The grooves between the bars may each have a groove bottom formed by an intersection of the leading face and a trailing face of a bar.

Another embodiment of the invention is a refiner plate for a mechanical refining system, the plate comprising: a refining surface including bars and grooves; each of the grooves has a width extending between the upper ridges of adjacent bars; the bars each have a leading face, an upper ridge surface and a leading edge formed by an intersection of the leading face and the upper ridge surface, wherein the leading edge has an interior angle between the leading face and the upper ridge surface of between 150 to 175 degrees, and wherein a width of the upper ridge surface of each bar is in a range of 30 percent to 75 percent of a total width of the ridge surface and the width of a groove.

A further embodiment of the invention is a method of mechanically refining lignocellulosic material in a refiner having opposing refiner plates, the method comprising: introducing the material to an inlet in one of the opposing refiner plates; rotating at least one of the plates with respect to the other plate, wherein the material moves radially outward through a gap between the plates due to centrifugal forces created by the rotation; as the material moves through the gap, passing the material over bars in a refiner section of a first one the plates, wherein the bars on at least one of the plates has a leading edge defined by an interior angle of between 150 degrees to 175 degrees, and discharging the material from the gap at a periphery of the refiner plates.

DETAILED DESCRIPTION OF THE INVENTION

Figure 1:
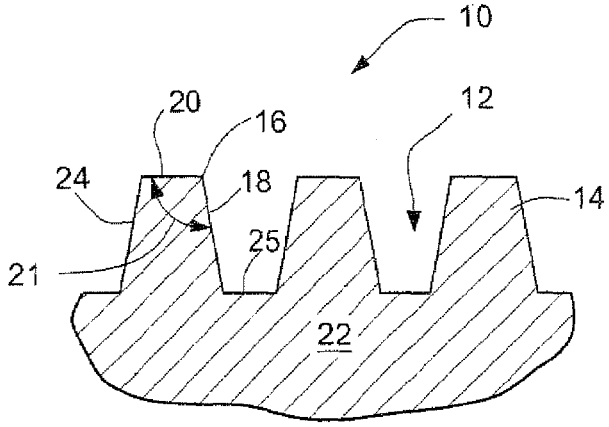
FIG. 1 (PRIOR ART)
FIG. 1 is a cross-sectional view of a portion of a conventional refiner plate, e.g., a rotor and stator plate, showing a conventional geometric cross-sectional shape of bars and grooves.

FIG. 1 is a cross-sectional view of a portion of a conventional refiner plate 10, e.g., a rotor or stator plate, showing a conventional geometric cross-sectional shape of bars 14 and grooves 12. The bars have a relatively sharp leading edge 16 formed by the intersection of the leading face 18 of the bar and the ridge 20 at the upper surface of the bar. The leading face 18 is a sidewall of the bar facing the direction of rotation if on a rotor plate and facing the approaching rotor bars if on a stator plate.

The angle of the leading edge is defined as the interior angle 21 between the leading face and ridge 20 of the bar. A conventional leading edge angle is sharp, such as in a range of 90 degrees to 100 degrees and may include leading edge angles as small as 75 degrees. The sharp leading edges on bars, e.g., having a leading edge angle of 75 to 100 degrees, tend to shear fibrous material caught between opposite bars as the bars on opposite refiner plates cross during rotation of one or both of the refiner plates.

The sharp leading edge of the conventional bar provides a steep leading face 18 that is nearly perpendicular with respect to the substrate 22 of the refiner plate. The trailing face 24 of a bar is on the opposite side of the bar to the leading face. The trailing face 24 is steep and typically forms an interior angle with the ridge 20 of between 90 to 100 degrees. The steep leading and trailing faces of the bar results in grooves 12 that are relatively wide from the top to the bottom 25 of the groove at the level of the substrate 22. The grooves typically have a generally flat surface bottom 25 between the lower corners of the leading and trailing faces of adjacent bars. The wide grooves 12 have large cross-sectional areas that allow for relatively large volumes of material flow, e.g., steam and water, through the grooves. The capacity of the wide grooves to pass large volumes of material enhances the capacity of the refiner plate apparatus to handle a large flow of fibrous material moving between the plates.

Figure 2:
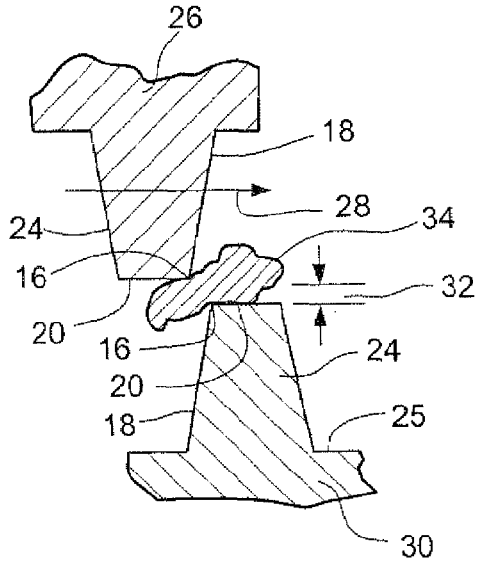
FIG. 2 (PRIOR ART)
FIG. 2 shows a crossing of conventional bars of opposing plates, where the bars are shown in cross-section.

FIG. 2 shows a crossing of conventional bars 26, 30 of opposing plates, where the bars are shown in cross-section. The plates may be a rotor plate 26 moving in a rotational direction (arrow 28) with respect to a stationary stator plate 30. The rotor and stator plates are opposite to each other, such that the ridges 20 of the bars on opposing plates pass each other with a relatively small refining gap 32, e.g., 0.5 to 4 millimeters, between the ridges. The refining gap 32 between the crossing bars tends to be the region where much of the refining action occurs to separate fibers from the fibrous material. The pressures and forces applied to the fibrous material in the refining gap are greater than the pressures and forces in regions between a groove and a bar, or between opposing grooves. The higher pressures and forces in the refining gap 32 cause the fibers to separate from the network of fibers in the fibrous material.

Fibrous material 34 being refined by the plates may be sheared in the gap 32 between the plates. The sharp leading edges 16 of the conventional bars can directly impact and shear the fibrous material 34. The shearing of wood fibrous material is not desired. Shearing may break fibers, reduce the length of the fibers in the pulp produced by refining and reduce the potential strength of fiber based products produced with the pulp. Shearing the fibrous material is believed to be most acute in the gap 32 as the sharp leading edges 16 cross of opposing bars. The sharp leading edge and the steep slope of the leading face of the bar tend to impact fibrous material between the plates. The impacts shear the fibrous material.

Figure 3:
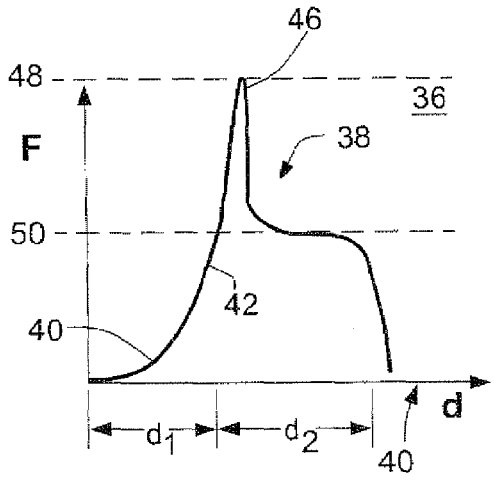
FIG. 3 is a chart of the force applied to fibrous material between the crossing bars shown in FIG. 2.

FIG. 3 is a chart 36 depicting the forces (F), as understood by the inventor, applied to fibrous material between the crossing bars shown in FIG. 2. The horizontal axis 40 of the chart 36 depicts movement of a bar moving through a distance (d) in the direction of the arrow 28. The trace 38 represents the force applied to the material between the refiner plates. As the ridge of a bar on one plate moves over the groove of an opposite plate (represented by distance d1), a very low force 40 is applied to the fibrous material between the bar and groove.

As the sharp leading edge and steep leading face of one conventional bar approaches the sharp leading edge and steep leading face of an opposite conventional bar, the force applied to the fibrous material between the bars increases dramatically, as indicated by the rapidly rising portion 42 of the force trace 38. As the leading edges of the opposing bars cross, the force spikes 46 because the leading bar edges violently impact the fibrous material. The force spike 46 is at an excessive level 48 that can shear the fibrous material, break fibers in the material and otherwise harm the material.

The ridges of the opposing bars cross during a distance d2 in FIG. 2. After the leading edges 16 of opposing bars cross and the bar ridges are opposite to each other, the force quickly reduces to a force level 50 which is relatively high. This high force level 50 results from a compressive pressure pulse applied by the crossing of the bar ridges 20. The high level of forces 50 is sufficient to refine the fibrous material, such as to cause fibers to be separated from the fiber network of a wood material. The high level of forces 50 is believed to not substantially shear the fibrous material or otherwise damage the material to the same extent that occurs by application of the excessive force level 48 during a force spike 46. The force spike 46 is an undesirable and unnecessary trait of many conventional refiner plates.

Figure 4:
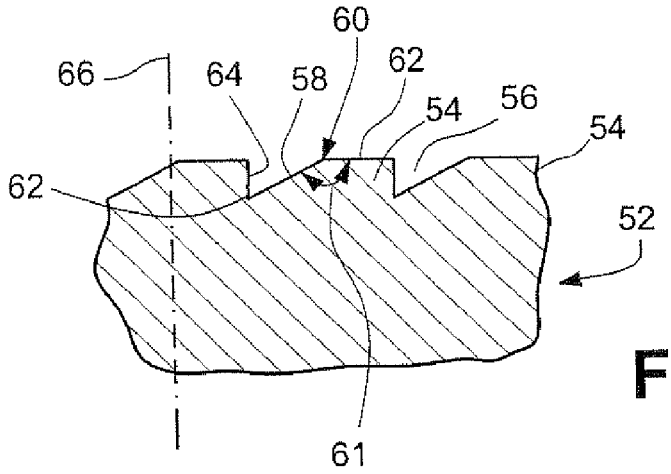
FIG. 4 is a cross-sectional view of a portion of a refiner plate, e.g., a stator plate, showing a novel geometric cross-sectional shape of bars and grooves.

FIG. 4 is a cross-sectional diagram of a refiner plate 52 having bars 54 and grooves 56. The bars have a leading face 58 having a slope of approximately 5 to 40 degrees with respect to a plane of the ridges of the bars. The slope may be applied to the entire leading face from the ridge to the substrate. Alternatively, the slope may be applied to an upper section of the leading face adjacent the ridge, while a lower section of the leading face is steeper, such as having a slope of 45 to 90 degrees.

The leading edge 60 is formed at the intersection of the leading face 58 and the ridge 62 of the bar. The interior angle 61 of the leading edge is dull and may be in a range of 140 degrees to 175 degrees, and preferably in a range of 155 degrees to 175 degrees, and most preferably at 160 degrees.

The leading face 58 has a shallow slope resulting from the dull leading edge angle. Because of its shallow slope, the leading face of each bar extends substantially the entire width of the groove 56. Due to its shallow slope and dull leading edge, the leading face 58 gradually applies an increasing compressive pressure to the fibrous material between the plates, as the leading face approaches a bar on an opposing plate. The trailing face 64 of the bars 54 may be substantially parallel, e.g., an interior angle of 90 degrees to 100 degrees, with respect to an axis 66 of the plate. The bar 54 and groove 56 shapes provide a compressive bars and groove pattern.

The grooves 56 between the bars are formed by the leading face and trailing face of adjacent bars. The slope of the leading face 58 of the bar gradually reduces the depth of the groove in a direction approaching the leading edge 60 of the bar. Due to the slope of the leading face 58, the groove may have a cross sectional shape of a triangle in which the leading face 58 and trailing face 64 intersect at the bottom 62 of the groove. The cross-sectional area of the groove should be sufficient to allow water, steam and other fluids in the fibrous material to flow through the grooves of the refiner plate without inhibiting the flow of the fibrous material between the opposing plates.

The grooves 56 are shallow, especially near the leading edge 60 of the bar. The shallow groove promotes smooth movement of the fibrous material through the refining gap between crossing bars. The shallow groove tends to move fibrous material into the refining gap between crossing bars. The dull leading edges and sloped leading faces of the bars shown in FIG. 4 tend to increase the concentration of fibrous material in the compression sites of the refining gap between the ridges of bars and thereby increase the energy applicable in compression refining. In contrast, conventional grooves tend to impact against fibrous material, do not provide a smooth transition over the leading edge and into the gap between opposing ridges of bars and tend to allow fibrous material to gather in the groove.

The grooves 56 shown in FIG. 4 have a reduced cross-sectional area as compared to conventional grooves, such as shown in FIG. 1. Due to the limited volume available in the grooves 56, the refiner plates with the reduced cross-sectional area grooves are most suited to be (but not necessarily) one of the following: (1) a compression bar edge design on one of the refining plates and a conventional bar edge design on the opposite refining plate; (2) a compression bar edge design and a conventional bar edge design alternating between the refining annular zones on opposite refining plates; (3) a compression bar edge design on both refining plates in conjunction, with flow-enhancing design features, such as steam pockets (as shown in U.S. Pat. No. 5,863,000), steam grooves (U.S. Pat. No. 4,676,440), pumping/feeding grooves, or (4) other modifications that enhance the capacity of the refiner plates to fibrous material water and steam.

Figure 5:
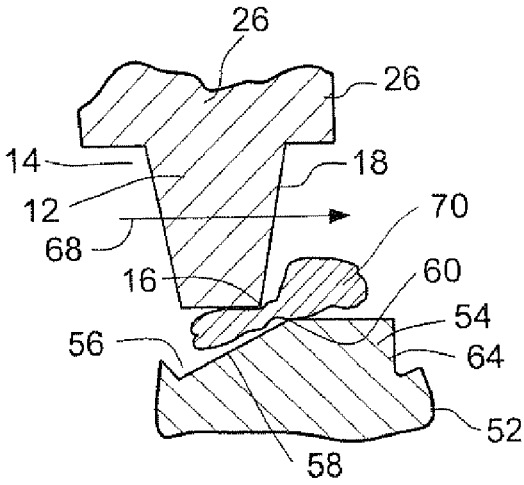
FIG. 5 shows a crossing of conventional bar of one refiner plate with a novel bar of an opposing refiner plate, opposing plates, wherein the bars are shown in cross-section.

FIG. 5 shows, in cross-section, the crossing of bars 54, 12, where one of the bars 54 has the dull leading edge shown in FIG. 4 and the opposite bar has a conventional sharp leading edged such as shown in FIG. 1. In this example, the bar crossing is shown with a rotor plate 26 having bars 12 having a leading face 18 with a sharp leading edge 16. The bars of the stator plate 52 have a sloped leading face 58 with a dull leading edge 60. The rotor plate moves in a rotational direction shown by the arrow 68.

The fibrous material 70 is refined in the gap between the opposing bars on the rotor and stator plates and, particularly, by the compressive pressure applied to the material as the opposing bars cross. The pressure applied to the fibrous material results from the crossing of the bars 12, 54 which reduces the gap between the refiner plates and thereby increases the pressure in the gap and applied to the fibrous material 70 in the gap.

The shallow slope of the leading face 58 of the stator bar 54 gradually increases the pressure applied to the fibrous material 70 as the bar 12 of the rotor passes over the groove 56 in the stator plate and approaches a leading edge 60 of the stator bar 54. The shallow slope of the leading face 58 of the stator bar reduces the tendency of the fibrous material to be violently impacted by the leading edges of the crossing bars. The gradual pressure increase resulting from the sloped leading face 58 and dull leading edge 60 of the stator bar is less prone to impacting and shearing of the material due to the profile of that bar. The sharp leading edge 16 of the rotor bar 12 in FIG. 5 is believed to be less prone to impacting and shearing the chip material because the fibrous material are not pinched between an opposing sharp leading edges of opposite bars.

Figure 6:
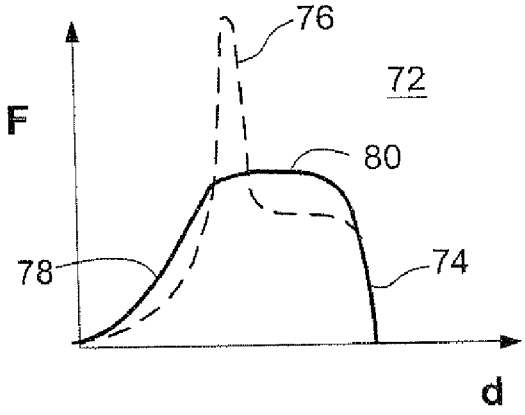
FIG. 6 is a chart of the force (solid line) applied to fibrous material between the crossing bars shown in FIG. 5, as compared to the force (dotted line) applied to fibrous material between the crossing bars shown in FIGS. 2 and 3.

FIG. 6 is a chart 72 depicting the forces (F), as understood by the inventor, applied to fibrous material between a crossing of the opposing bars shown in FIG. 5 and FIG. 2. The solid line force trace 74 depicts the perceived forces applied to fibrous material 70, e.g., wood chips, between the rotor and stator plates 26, 52 shown in FIG. 5. The dotted line trace 76 shows the perceived forces applied to the fibrous material 34 between the rotor and stator plates 26, 30 shown in FIG. 2.

The dotted line trace 76 is similar to the trace 38 shown in the chart 36 of FIG. 3. The dotted line trace 76 is presented in FIG. 6 by way of comparison to illustrate the pressure spike resulting from the crossing of bars with conventional sharp leading edges as compared to the pressures (shown by solid line trace 74) that result from bar crossings, wherein at least one of the bars has a sloped leading face and dull leading edge, (a "compression bar design.")

The solid line force trace 74 shows the gradual increase 78 in forces applied to the fibrous material as the leading edge 16 of the rotor bar 12 passes over the groove 56 of the stator bar 54. The gradual increase in force is in contrast to the rapid rise in force (see trace portion 42 in FIG. 3) that is believed to occur when conventional bars having sharp leading edges approach, as shown by the dotted line trace 76 in FIG. 6. The shallow slope of the leading face 58 of the stator compression bar 54 is believed to cause the forces to increase gradually to a maximum force, indicated by the crest 90 of the force trace 74.

The solid line force trace 74 shows substantially no spike in impact forces being applied to the fibrous material by the crossing of a the dull leading edge of a compression bar and a sharp leading edge of the rotor bar. The spike of impact forces (see spike in dotted line 76) as opposing sharp leading edges crossed in conventional bar profiles are believed to be avoided when at least one refiner plate has compression bars, such as bar 54 shown in FIG. 5.

The high level of forces 80 applied to the fibrous material in the compression stage of the bar crossing are sufficient to refine the material. The shallow slope of the leading face of the stator bar is believed to avoid a force spike as the leading edges cross of opposing bars. Avoiding the spikes in the forces applied to the fibrous material reduces the shearing of fibrous materials as the leading edges of opposite bars cross. The maximum force level 80 occurs as the ridges of the opposite bars cross. After the bars cross, the forces on the chip material are reduced as the bars pass over an opposing groove. The forces shown in FIG. 6 are repeatedly applied to the fibrous material as the rotor bars cross the stator bars.

Figure 7:
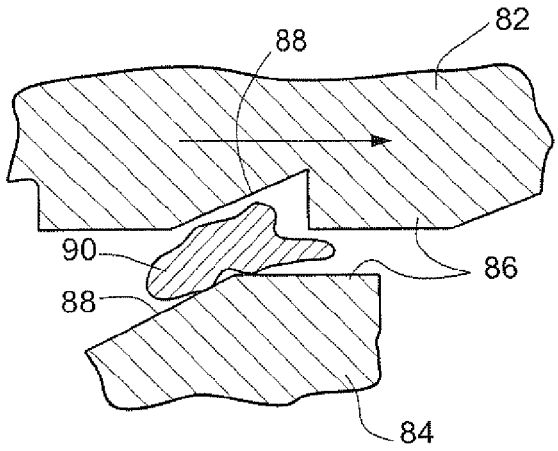
FIG. 7 shows the crossing of bars both of which have novel profiles, of opposing plates, where the bars are shown in cross-section.

FIG. 7 shows in cross-section a rotor plate 82 and a stator plate 84 which both have bars 86 having leading faces 88 with shallow slopes and dull leading edges. The fibrous material 90 is subjected to repeated compression pulses as the bars cross as the rotor plate moves in the rotation direction indicated by the arrow. The forces applied to the fibrous material by the crossing bars 86 tend to be entirely or at least primarily due to compression forces applied to the material. The crossing bars have a cross-sectional profile, e.g., sloped leading face and dull leading edge, that minimize impact forces applied when the bars cross. The minimization of impact forces should reduce or eliminate the shearing of fibers due to the crossing of the leading edges of opposing bars.

As shown in FIGS. 4 and 7, compression bars with a dull leading edge and a leading face having a shallow slope may be arranged on one or both of a pair of opposing plates. Preferably, these bars are arranged on at least the stator plate (see FIG. 5), but may be arranged solely on a rotor plate or on both opposing plates, e.g., a rotor-rotor pair of plates and a rotor-stator pair of plates (FIG. 7).

Figure 8A:
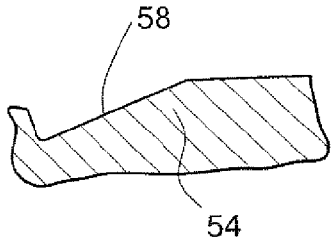
FIGS. 8*a* and 8*b* show in a cross-section bars having a flat leading sidewall (8*a*) and a curved leading sidewall (8*b*).
Figure 8B:
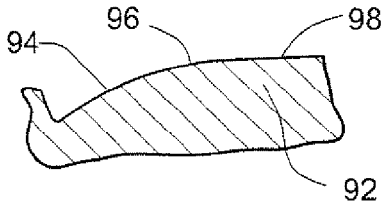

FIGS. 8A and 8B each show in cross-section a portion of a refiner plate having bars 54, 92 with dull leading edges and leading faces having a shallow slope. The bar 54 shown in FIG. 8A is substantially the same as the bar 54 shown in FIG. 4. Particularly, the leading face 58 of the bar 54 is substantially planar and forms a straight line in cross-section. The bar 92 shown in FIG. 8B has a convex leading face 94 that merges into the ridge 98 of the bar without any creases or other abrupt changes at the leading edge 96 of the bar 92. The planar leading face 58 shown in FIG. 8*a* may facilitate fabrication, e.g., molding, of the plate. The convex leading face 94 and curved leading edge 96 section of bar 92 shown in FIG. 8*b* may minimize impacts and spikes in the forces applied to the fibrous material due to the crossing of the leading edges of bars in opposite plates.

Figure 9:
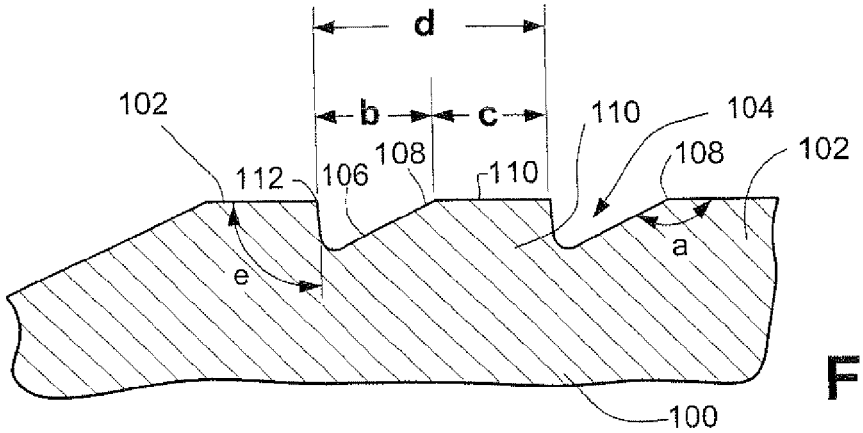
FIG. 9 is an enlarged cross-sectional view of a portion of a refiner plate, e.g., a stator plate, showing a novel geometric cross-sectional shape of bars and grooves.

FIG. 9 is an enlarged cross-sectional view of a portion of a refiner plate 100, e.g., a stator plate, showing a novel geometric cross-sectional shape of bars 102 and grooves 104. The bars have a sloped leading face 106 and a dull leading edge 108. It is preferable that the width (c) of the bar ridge 110 be substantially equal to the width (b) of the groove 104. For example, the widths of the grooves and bars may be each in a range of two to eight millimeters (mm) and, preferably, in a range of two to four millimeters. The ratio of bar width to the combined widths (d) of bar and groove should be in a range of 30 percent to 75 percent, and preferably in a range of 40 percent to 60 percent.

The angle (a) of the leading edge 108 of the bar 102 should be in a range of 150 degrees to 175 degrees. The angle (e) of the trailing bar edge 112 should preferably in approximately 90 degrees, such as between 80 degrees to 100 degrees. A sharp angle on the trailing edge provides a trailing face with a steep slope and allows for deep grooves having a relatively large cross-sectional area. Alternatively, the trailing edge angle (e) may be wide, e.g., 150 degrees to 175 degrees, especially if the refiner plate is to operate in either rotational directions.

The groove cross-sectional area should be sufficient to allow the fibrous material, steam and water to pass between the refiner plates. In addition, the groove should have a depth sufficient to allow compression relief after the bars have crossed. A groove that is too shallow may be inadequate to provide compression relief after the bars cross. Without sufficient compression relief, the efficiency of the energy transfer to the fibrous may be reduced.

The shape of the groove and the sidewalls of the bars may be designed to provide sufficient cross-sectional area for the groove and compression relief to the fibrous material. Preferably, the upper portion of the leading sidewall is sloped and the leading edge is dull, as described above, to minimize the impacts by the leading edges on fibrous material as the bars cross. The lower portion of the leading sidewall my be steeply sloped or substantially perpendicular to the substrate to increase the cross-sectional area of the plate.

Figure 10:
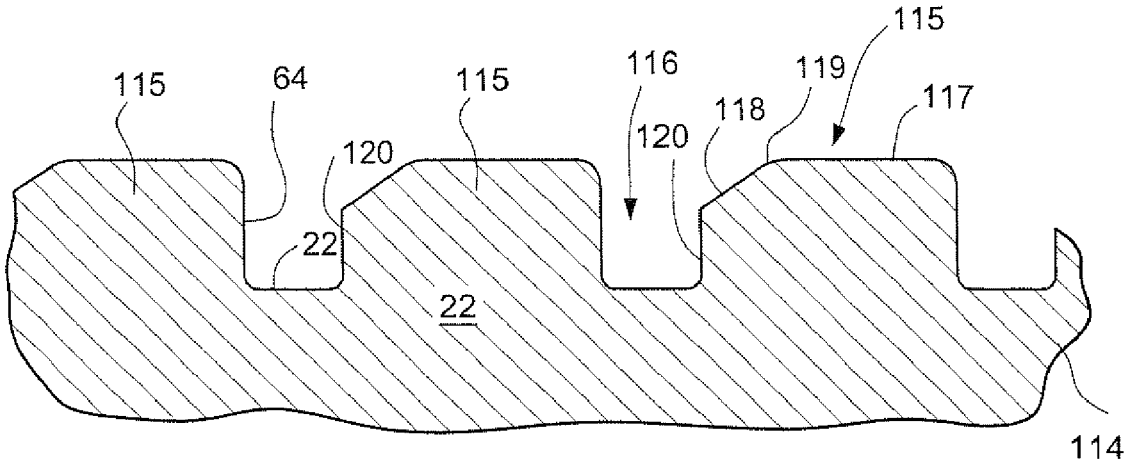
FIG. 10 is an enlarged cross-sectional view of a portion of a refiner plate, e.g., a stator plate, showing another novel geometric cross-sectional shape of bars and grooves.

FIG. 10 is an enlarged cross-sectional view of a portion of a refiner plate 114, e.g., a stator plate, showing another novel geometric cross-sectional shape of bars 115 and grooves 116. The bars include a generally flat upper ridge 117 and a leading sidewall having a sloped upper sidewall section 118 with a curved leading edge 119 as the sidewall merges into the upper ridge. The leading sidewall also includes a substantially straight lower sidewall section 120 to increase the depth and cross-sectional area of the groove.

The lower sidewall section 120 of the leading sidewall and the trailing sidewall 64 may have draft angles, e.g., angles from a line perpendicular to the substrate 22 of the plate, of less than one or two degrees and be substantially perpendicular to the substrate 22 of the plate 114. The transition between the upper sidewall section 118 and lower sidewall section 120 may be determined to provide a desired cross-sectional area of a groove and is preferably approximately in the middle of the bar between the upper ridge 117 and substrate 22.

Figure 11:
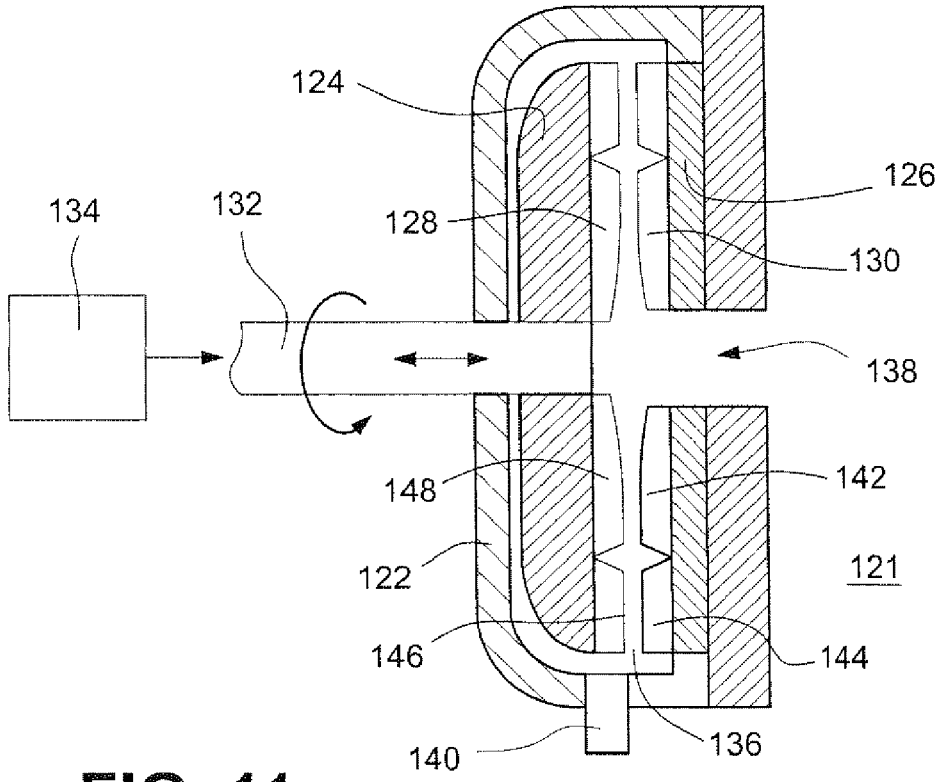
FIG. 11 is a cross-sectional diagram showing a refiner having a refiner housing for an annular rotor disc and plate assembly and an annular stator disc and plate assembly.

FIG. 11 is a cross-sectional diagram showing a refiner 121 having a refiner housing 122 that encloses an annular rotor disc 124 and an annular stator disc 126. The discs each support, respectively, an annular rotor plates 128 (which may also be an annular assembly of plate segments) and an annular stator plate 130 (which may also be an annular assembly of plate segments). The rotor disc 124 is mounted on a shaft 132 that is rotated (see arrow on a half circle) by a motor 134. A mechanical adjustment, e.g., a screw, moves the shaft axially (see doubled headed arrow) to move the rotor disc and plate axially relative to the stator disc and plate. The axial adjustment determines the gap 136 between the opposing surfaces of the plates.

Unrefined fibrous material is introduced through a center inlet 138 of the stator disc and enters the gap 136 between the plates. The material moves radially outward through the gap due to the centrifugal forces imparted by the rotation of the rotor disc. As the material moves between the plates, the material passes between crossing bars of the opposing plates and is thereby refined into a pulp having separated fibers. The refined pulp exits the gap 136 at the peripheries of the refiner plates and is discharged through outlet 140 from the refiner. Each refiner plate 141 may include multiple annular and concentric refining zones 142, 144, 146 and 148. The refining zones each have a pattern of bars and grooves arranged on the surface of the refining plate. Generally, opposing plates have similar annular refining sections that are aligned when placed in the refiner. The stator plate 130 may, for example, include an inner annular section 142 having bars with dull leading edges and shallow leading faces and an outer annular section 144 having bars with sharp leading edges and steep sloped leading faces. The rotor plate 128 may have an inner annular section 148 having bars with sharp leading edges and steep leading faces and an outer annular refining section 146 having bars with dull leading edges and shallow leading faces.

Figure 12:
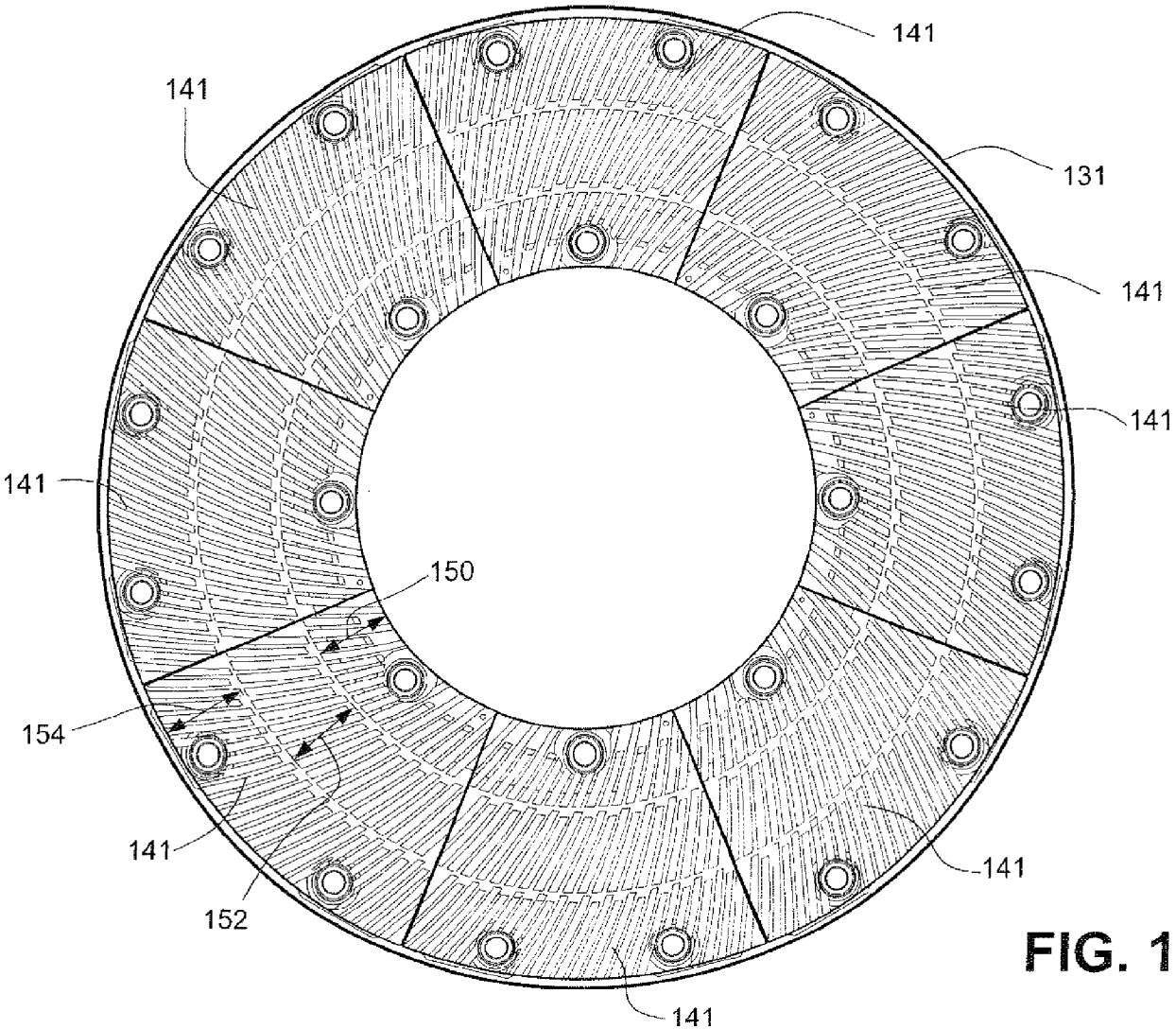
FIG. 12 is a front view of the annular stator disc shown in FIG. 11.

FIG. 12 is a front view that generically shows a disc 131, that may be a rotor disc or stator disc. An annular array of refiner plates 141 are arranged on the disc 131. Refiner plates often include two or more annular refining zones 150, 152 and 154. Each refining zone typically has a uniform pattern of bars and grooves.

It is preferable, that bars with dull leading edges and shallow sloped leading faces be on at least one plate of a pair of opposite plates for each of the annular refining sections. However, pairs of opposite plates may be arranged such that one or more of the annular refining zones 150, 152 have bars with sharp leading edges and steep leading faces on both plates, and at least one annular refining zone 154 has bars with dull leading edges and shallow sloped leading faces on at least one of the plates.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A mechanical refining system including opposing refiner plates, at least one of the plates comprising:

a fibrous material inlet region radially inward of a refining surface and a refined fibrous material outlet radially outward of the refining surface;

the refining surface including bars and grooves, wherein each of the bars has a leading edge between an upper sidewall section of a leading face and an upper ridge of the bar, wherein the upper ridge surface has a planer surface extending between the leading edge and a trailing edge of the bar;

wherein the leading face is oriented towards a direction of rotation of the opposing plate and the leading edge has an interior angle of between 150 degrees to 175 degrees between the upper sidewall section and the upper ridge, and the upper sidewall section extends from the upper ridge to at least a middle of the leading face between the upper ridge and a bottom of one of the grooves adjacent the bar, and each of the bars has the trailing edge forming an interior angle less than the interior angle of the leading edge, and the trailing edge is between the upper ridge and a trailing face of the bar.

2. The mechanical refining system of claim 1 wherein the leading face for each bar extends from the leading edge to a trailing face of an adjacent bar.

3. The mechanical refining system of claim 1 wherein the leading face includes a lower sidewall section substantially perpendicular to the upper ridge and below the upper sidewall section.

4. The mechanical refining system of claim 1 wherein the upper sidewall section is concave or convex in cross-section.

5. The mechanical refining system of claim 1 wherein the trailing edge has an interior angle of between 85 degrees to 140 degrees.

6. The mechanical refining system of claim 1 wherein the grooves each have a bottom formed by an intersection of the leading face and a trailing face of an adjacent bar.

7. The mechanical refining system of claim 1 wherein the refiner plate is a stator plate and the leading face is oriented facing approaching bars of a rotor plate, wherein the opposing refiner plates comprise the stator plate and the rotor plate.

8. The mechanical refining system of claim 1 including a plurality of refining zones arranged radially on the plate and, at least one of the zones includes the refining surface.

9. A mechanical refining system including opposing refiner plates, at least one of the plates comprising:

a fibrous material inlet region radially inward of a refining surface and a refined fibrous material outlet radially outward of the refining surface;

the refining surface including bars and grooves between the bars;

the bars each have a leading face, an upper ridge surface and a leading edge formed by an intersection of an upper sidewall section of the leading face and the upper ridge surface, wherein the leading face faces a direction of rotation of the opposing plate, and wherein the upper ridge surface has a planer surface extending between the leading edge and a trailing edge of the bar;

the upper sidewall section extends from the upper ridge surface to at least a middle of the bar between the upper ridge surface and a bottom of one of the grooves adjacent the bar, and an entirety of the upper sidewall has an interior angle of between 150 to 175 degrees with respect to the upper ridge surface;

each of the bars has a trailing face and the trailing edge formed by an intersection of the trailing face and the upper ridge surface, wherein the trailing edge has an interior angle less than the interior angle of the interior angle of the upper sidewall of the leading face;

each of the grooves has a width extending between the upper ridges of adjacent bars, and wherein a width of the upper ridge surface of each bar is in a range of 30 percent to 75 percent of a total width of the ridge surface and the width of a groove.

10. The mechanical refining system as in claim 9 wherein the width of the upper ridge surface of the bar is in a range of 80 percent to 120 percent of the width of the one of the grooves adjacent the bar.

11. The mechanical refining system as in claim 9 wherein the refining surface is in an annular refining zone of the refiner plate.

12. The mechanical refining system as in claim 9 wherein the leading face includes a lower sidewall section substantially perpendicular to a substrate of the bar and below the upper sidewall section.

13. The mechanical refining system of claim 9 wherein the leading face extends from the leading edge to a trailing face of an adjacent bar.

14. The mechanical refining system of claim 9 wherein the bars each have a width at the upper ridge between 80 percent to 120 percent of a width of the at least one of the grooves adjacent the bar.

15. The mechanical refining system of claim 9 wherein the upper sidewall is concave or convex in cross-section.

16. The mechanical refining system of claim 9 wherein the bars include a trailing edge having an interior angle of between 85 degrees to 140 degrees between the upper ridge and a trailing face.

17. The mechanical refining system of claim 9 wherein the grooves each have a bottom formed by an intersection of the leading face and a trailing face of an adjacent bar.

18. The mechanical refining system of claim 13 wherein the grooves each have a bottom portion defined by the trailing face and a lower sidewall section of the leading face of adjacent grooves, wherein the lower sidewall section forms an angle of between 88 degrees and 92 degrees with respect to a substrate of the plate and is below the upper sidewall section.

19. The mechanical refining system of claim 9 including a plurality of refining zones arranged radially on the plate and, at least one of the zones includes the refining surface.

* * * * *